US011246785B2

(12) United States Patent
Vilhelmsen

(10) Patent No.: US 11,246,785 B2
(45) Date of Patent: Feb. 15, 2022

(54) FOOT PILLOW AND METHOD OF TREATING FOOT PAIN AFTER RESTING HORIZONTALLY

(71) Applicant: Kurt Vilhelmsen, Buckley, WA (US)

(72) Inventor: Kurt Vilhelmsen, Buckley, WA (US)

( * ) Notice: Subject to any disclaimer, the term of this patent is extended or adjusted under 35 U.S.C. 154(b) by 353 days.

(21) Appl. No.: 15/209,601

(22) Filed: Jul. 13, 2016

(65) Prior Publication Data

US 2018/0014992 A1 Jan. 18, 2018

(51) Int. Cl.

| | |
|---|---|
| ***A61H 1/02*** | (2006.01) |
| ***A63B 23/10*** | (2006.01) |
| *A63B 23/00* | (2006.01) |

(52) U.S. Cl.

CPC ..... *A61H 1/0266* (2013.01); *A63B 23/10* (2013.01); *A61H 2201/0134* (2013.01);

(Continued)

(58) Field of Classification Search

CPC .. A61H 1/0266; A61H 2001/027; A61H 7/00; A61H 7/001; A61H 1/0262; A61H 2201/0134; A61H 2201/1261–1284; A61H 39/00; A61H 39/04; A61H 1/02; A61H 1/0237; A61H 1/0255; A61H 2201/1253–1284; A61H 7/007; A61G 13/12; A61G 13/1205; A61G 13/1245; A61G 13/125; A61G 13/126;

(Continued)

(56) References Cited

U.S. PATENT DOCUMENTS 2,468,327 A * 4/1949 Hartung ..... A61H 7/001 606/237
2,476,921 A * 7/1949 Amzy ..... A61H 7/001 482/79

(Continued)

FOREIGN PATENT DOCUMENTS

CA 2121023 A1 * 10/1995 ..... A47G 27/0231

OTHER PUBLICATIONS

Test Resources, Indentation Load Force Deflection (ILD or IFD), Sep. 26, 2018, https://www.testresources.net/applications/test-types/indentation-ifd-test/indentation-load-force-deflection-ild-or-ifd-urethane-plastic-foam-test-equipment/.*

(Continued)

*Primary Examiner* — Michelle J Lee
(74) *Attorney, Agent, or Firm* — Dean Craine; Marisa Whitaker

(57) ABSTRACT

A foot pillow designed to be used by an individual with plantar fasciitis and suffers from severe foot pain when the individual attempts to stand or walk after resting horizontally. The pillow is a square or rectangular structure with a flat bottom and a dome or conical-shaped top surface. The pillow is made of elastic foam sufficient size, thickness and compression rating to support the user's arch when standing on the pillow's center axis. Because the pillow is domed or conical shape, the pillow has less arch support near its perimeter edge. During use, the user stands in place and repeatedly lifts and press both feet into the top surface near the pillow's center axis. Over a few minutes, the user lifts his feet and gradually moves them outward towards the perimeter edge thereby enabling the plantar fascia on each foot to gradually stretch before being fully extended when standing or walking.

1 Claim, 1 Drawing Sheet

(52) U.S. Cl.
CPC ..... *A61H 2201/1261* (2013.01); *A61H 2201/1284* (2013.01); *A63B 2023/006* (2013.01)

(58) Field of Classification Search
CPC .... A61G 13/127; A61G 13/10; A63B 23/035; A63B 23/04; A63B 23/10; A63B 2023/006; A63B 23/0458; A63B 23/0464; A63B 26/003; A63B 23/00; A63B 23/03516; A63B 23/03525; A63B 26/00; A63B 2026/006; A63B 21/02; A63B 21/028; A63B 21/04; A47G 27/00; A47G 27/02; A47G 27/0212; A47G 27/0231; A47G 27/0237; A47C 16/02; A47C 16/00
See application file for complete search history.

(56) References Cited

U.S. PATENT DOCUMENTS 3,828,378 A * 8/1974 Flam ..... A61G 7/05707 5/730
4,253,661 A * 3/1981 Russell ..... A63B 21/00047 482/51
5,158,073 A * 10/1992 Bukowski ..... A61H 39/04 5/944
6,315,786 B1 * 11/2001 Smuckler ..... A43B 7/14 36/145
2002/0008181 A1 * 1/2002 Lamont ..... A61G 7/1038 248/125.3
2002/0091343 A1 * 7/2002 Chen ..... A61H 7/001 601/136
2005/0228332 A1 * 10/2005 Bushby ..... A43B 7/142 602/61
2008/0314393 A1 * 12/2008 Purcell et al. ..... A61F 11/00 128/865
2012/0040810 A1 * 2/2012 Astilla ..... A63B 23/10 482/131
2014/0245700 A1 * 9/2014 Bushby ..... A43B 7/1405 53/435
2014/0342126 A1 * 11/2014 Oh ..... B32B 37/14 428/160
2016/0007787 A1 * 1/2016 Johnson ..... A47G 27/0231 428/58
2016/0255977 A1 * 9/2016 Burkhalter ..... B32B 5/245
2016/0270998 A1 * 9/2016 Nielsen ..... A61H 1/0266
2017/0172331 A1 * 6/2017 Publicover ..... A63B 5/11

OTHER PUBLICATIONS

The Foam Factory, Foam Firmness and Compression Strength, Nov. 8, 2011, https://www.thefoamfactory.com/blog/index.php/foam-firmness-and-compression-strength-understanding-these-assesments-and-what-they-mean-to-you (Year: 2011).*

* cited by examiner

FOOT PILLOW AND METHOD OF TREATING FOOT PAIN AFTER RESTING HORIZONTALLY

This utility patent application is based on and claims the filing date benefit of U.S. provisional patent application (Application 62/191,7150) filed on Jul. 13, 2015.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to foot massaging devices, and more particularly to such devices that an individual uses in an upright position to relieve foot discomfort.

2. Description of the Related Art

The plantar fascia is a flat band ligament that connects the heel bone to the toes and supports the arch of the foot. When the plantar fascia becomes irritated or swollen (condition known as plantar pasciitis), pain is produced in the bottom of the foot near the heel. It is postulated that when the plantar fascia is irritated and suddenly stretched, severe pain is produced, (between 8 and 10 on a 10 point pain scale). If the plantar facia is relaxed and allowed to rest and then slowly stretched, less pain is produced, (between 2 to 4 on a 10 point pain scale).

When sleeping or resting horizontally, the plantar fascia can relax. Unfortunately, 7 to 9 nine hours of rest with the feet horizontal on a bed is an insufficient rest period for irritated plantar fascia. Although the heel pain may subside when laying horizontally, when standing or walking after resting, the pain can be very severe.

To reduce irritation and severe pain, suffers of plantar fasciitis sometimes wear special foot boots with high arches when sleeping. The foot boots are worn when sleeping so the user may walk to the rest room at night. Unfortunately, such boots are uncomfortable and interfere with the user's sleep.

What is needed is a device that treats severe foot pain that occurs when an individual who suffers with plantar fasciitis stands after resting horizontally. What is also needed is a device that does not interfere with the user's sleep.

SUMMARY OF THE INVENTION

Disclosed herein is a foot pillow designed to be used by an individual who has plantar fasciitis and suffers with severe heel or foot pain when the individual stands after resting horizontally. The foot pillow includes a square or rectangular body with a flat bottom surface and a dome or conical-shaped top surface with thinner perimeter edges. The foot pillow is made of elastic foam sufficient size to allow the user to stand in place and repeatedly lift and press both feet into the top surface. The elastic foam is configured to resiliently compress under the foot. When the foot is lifted, the area of the body under the foot expands and returns to its original position.

The body is thicker at or near its center axis. The body may be conical or wedge shaped with at least one downward diagonal surface. The diagonal surface intersects with a narrow perimeter edge. The body at its center axis is sufficiently thick to support the user's arch on his or her foot when standing near or at the center axis. When foot is moved outward over the body, the pillow's thickness is reduced thereby providing less arch support.

Using the above pillow, a method for reducing heel pain by an individual suffering with plantar fasciitis after resting horizontally is described that requires the individual to place the above described foot pillow on the floor next to the bed or couch, standing on the pillow with both feet at or near the pillow's center axis where the pillow is thicker, and then repeatingly walk in place over the foot pillow for 1 to 4 minutes and gradually moving the feet towards the pillow's narrow perimeter edge, and then before walking directly over the floor.

DESCRIPTION OF THE PREFERRED EMBODIMENT(S)

Figure 1:
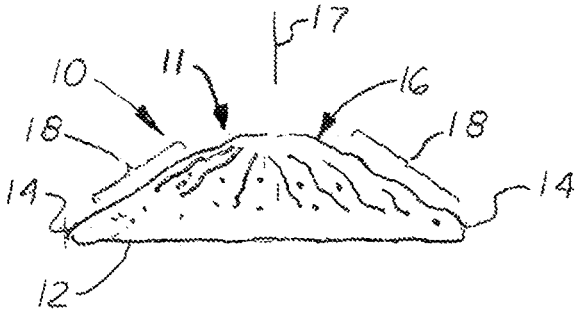
FIG. 1 is a side elevational view of a foot pillow.
Figure 2:
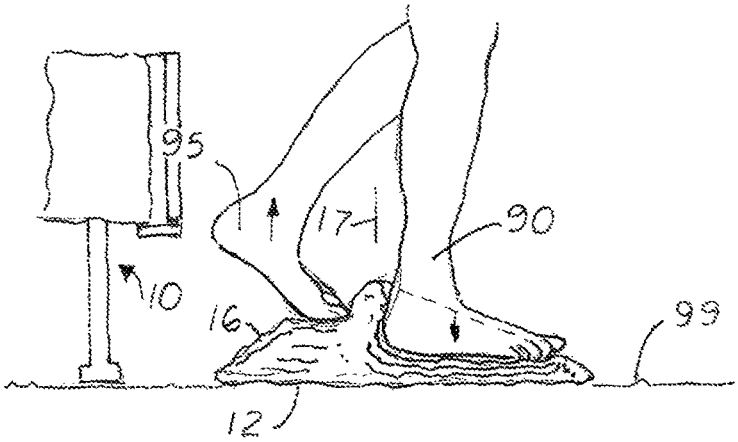
FIG. 2 is a side elevational view of the foot pillow located adjacent to a bed showing an individual standing that experiences severe foot pain caused by plantar fasciitis when standing or walking after resting horizontally, showing the individual placing his or her feet on the foot pillow and repeatedly stepping and lifting her feet over the foot pillow.
Figure 3:
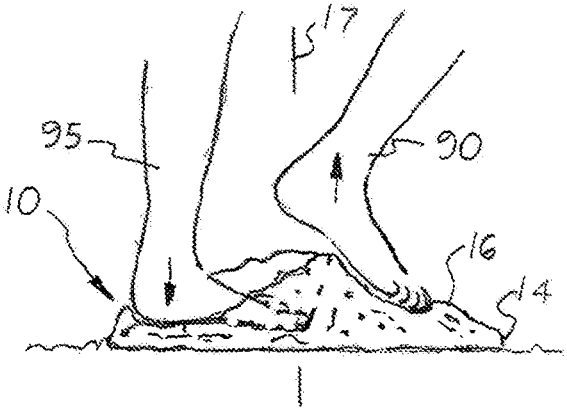
FIG. 3 is a side elevational view of the foot pillow located adjacent to a bed showing an individual standing in place over the pillow and repeatedly step and lifting or her feet over the pillow.
Figure 4:
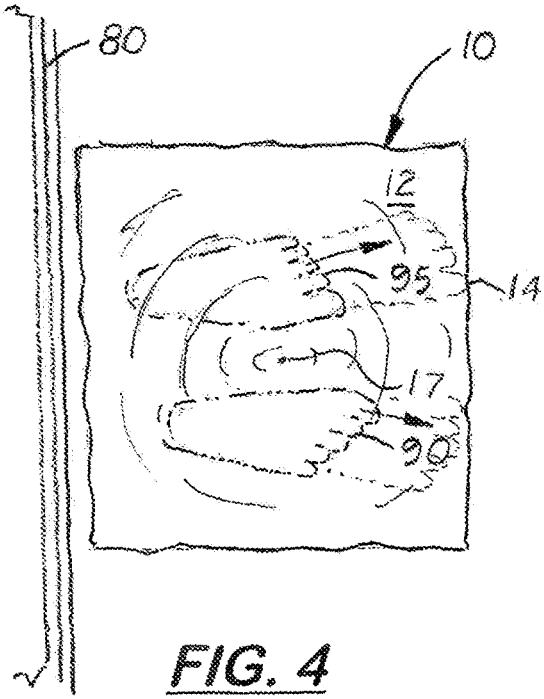
FIG. 4 is a top plan view of the foot pillow showing the location of the user's feet.

A foot pillow 10 designed to be used by an individual who suffers with foot pain that occurs when the individual stands after resting horizontally. The pillow 10 is a square or rectangular structure with a flat bottom surface 12 and a dome or conical shaped top surface 16. The pillow 10 is made of elastic polyurethane foam sufficient size to allow the user to stand in place and repeatedly lifting and stepping each foot 90, 95 into the top surface 16. The foot pillow is made of elastic foam designed to resiliently compress under the foot. When the foot 90, 95 is lifted, the pillow area under the foot expands and returns to its original position as shown in FIGS. 2 and 3.

In the embodiment shown, the body 11 has a square or rectangular bottom surface 12 that measures fourteen to twenty-four inches wide and fourteen to twenty-four inches long. It should be understood that the bottom surface 12 of the body 11 may be circular or oval. The thickness of the pillow 10 at the center axis 17 is approximately 4 to 10 inches. The section of the top surface 16 near the center axis 17 is convex. The diagonal section 18 of the top surface 16 that extends from the center axis 17 to the perimeter edge 14 is aligned 20 to 30 degrees from the bottom surface 12. The outer perimeter edge 14 of the pillow 10 are approximately 1 inch thick.

The pillow 10 has a firmness or compression rating between IFD 10 to IFD 30. The density of the pillow 10 is between 1 to 5 lb./cubic ft.

Using the above pillow 10, a method for treating heel pain that occurs when walking or standing after a person with plantar fasciitis has been resting horizontally is taught.

The method includes the step of selecting the above describe foot pillow 10, placing the foot pillow 10 on the floor 99 adjacent to the bed or couch 80 with the bottom surface 12 facing downward the top surface 16 facing upward. When the user who has been resting horizontally wants to stand, she places both feet 90, 95 on the top surface 16 near the pillow's center axis 17 and stands. The user then repeatedly walks in place over the pillow 10 lifting and stepping each foot 90, 95 into the top surface 16 as shown in FIGS. 2 and 3. The user continues to walk on the pillow for 1 to 4 minutes until foot pain is reduced. The user may gradually moves his or her feet towards the pillow's perimeter edge 14 before stepping completely off the pillow 10. The user then steps off the pillow 10 and stands or walks away.

In compliance with the statute, the invention described has been described in language more or less specific on structural features. It should be understood however, that the invention is not limited to the features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A method for treating severe foot pain caused by plantar fasciitis in feet of an individual standing or walking after resting horizontally, comprising the following steps:

a. selecting a foot pillow that includes a body made of elastic material, said body includes a center axis, a bottom surface and a dome-shaped top surface that extends diagonally downward from said center axis and intersects with said bottom surface to form a thin, continuous perimeter edge, a section of said body located at said center axis being sufficiently thick to provide arch support for the individual when standing on said top surface near said center axis, said top surface tapers downward from said center axis to said perimeter edge thereby gradually reducing the amount of arch support as said feet are moved outward towards said perimeter edge, said elastic material having a compression rating between IFD 10 to IFD 30 and a density rating between 1 to 5 lb./cubic ft;

b. placing said bottom surface of said body on a floor adjacent to said individual resting horizontally;

c. placing the individual's bare feet directly on said top surface of said body so that said top surface of said body directly supports the arches of said feet; and d. repeatedly lifting and lowering said feet over said top surface for 1 to 4 minutes starting from said center axis and moving towards said perimeter edge thereby providing less support to said arches on said feet and relieving foot pain caused by plantar fasciitis prior to walking onto said floor.

* * * * *